United States Patent [19]

Tyson

[11] Patent Number: 4,757,308

[45] Date of Patent: Jul. 12, 1988

[54] POSITION DETECTOR WITH SNAP ACTION TOGGLE

[75] Inventor: Michael P. Tyson, Fairport, N.Y.

[73] Assignee: Metscan Inc., Honeoye Falls, N.Y.

[21] Appl. No.: 791,169

[22] Filed: Oct. 24, 1985

[51] Int. Cl.[4] ..... G08B 21/00; H01H 21/04

[52] U.S. Cl. ..... 340/686; 200/67 A; 340/688

[58] Field of Search ..... 340/688, 686, 870.02, 340/870.29; 200/67 DB, 67 D, 67 A; 346/14 MR; 250/561, 231 SE, 551; 356/141

[56] References Cited

U.S. PATENT DOCUMENTS

| | | | |
|---|---|---|---|
| 3,363,148 | 1/1968 | Freeman | 340/688 X |
| 4,196,325 | 4/1980 | Povilaitis | 200/67 A |
| 4,588,982 | 5/1986 | Goodwin | 340/688 X |

*Primary Examiner*—Joseph A. Orsino

*Assistant Examiner*—Thomas J. Mullen, Jr.

*Attorney, Agent, or Firm*—Hoffman Stone

[57] ABSTRACT

A position detector for generating output signals indicative of changes in the position of a cyclically moving object such as the pointer on a selected dial of a meter comprising a snap action toggle mechanism, drive means responsive to motion of the moving object for operating the toggle through one complete cycle for each cycle of motion of the object, and a photo coupler device for sensing the instantaneous position of the toggle. The coupler is positioned as a stop for the toggle at one limit of its travel, and the toggle reflects light from the coupler back to the coupler when it is at its other, opposite, limit position. When the toggle is at the one limit it covers the emitting and receiving faces of the coupler, thereby positively inhibiting it so that it cannot produce a positive output signal.

3 Claims, 1 Drawing Sheet

FIG. 1
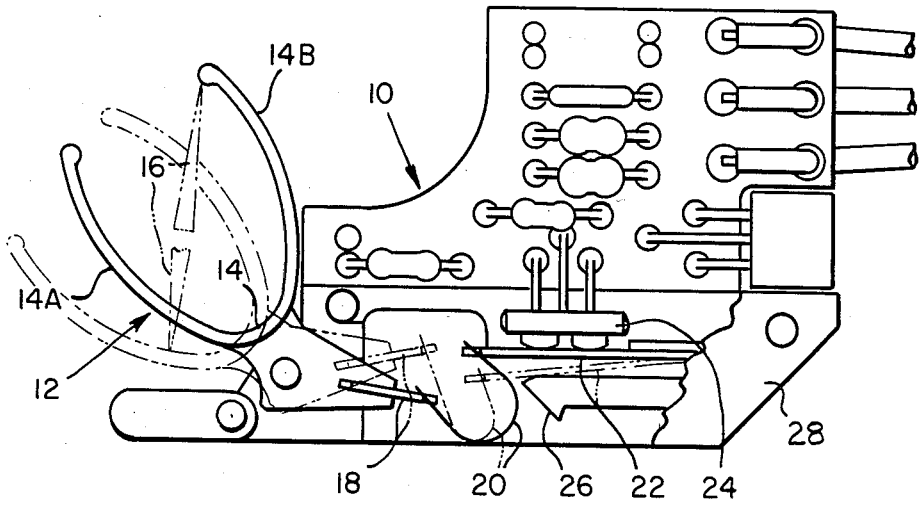
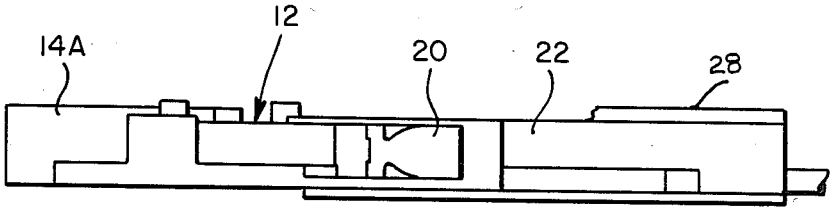
FIG. 2

POSITION DETECTOR WITH SNAP ACTION TOGGLE

This invention relates to a novel sensor including a snap action toggle mechanism for detecting changes in position of an object under observation with a high degree of reliability and minimum possibility of ambiguity.

The invention arose in the course of efforts to improve a remote meter reading system in which it was desired to count the rotations of a needle on the dial of a meter such as a domestic gas meter, and thereby to produce electrical output signals that could be stored in an electrical register, summed, and periodically transmitted to a central processing office.

Previous arrangements of this kind usually included a permanent magnet, means for mounting the magnet on the face of the meter for rotation by a selected one of the indicator pointers, or needles, and magnetic sensing means for counting the revolutions of the magnet. That approach, although widely used and frequently satisfactory, presented a few problems that are resolved by the detector of the present invention.

One of the problems relates to the relatively large number of design differences among the meters currently in use to which it is desired to fit the detector. It has been found that at least one hundred sixty six differently designed meters are in commercial use in the United States, and in order to fit the magnetic detectors to individual ones it was necessary to make numerous modifications in the detectors. Many different detectors, or many different adaptor kits had to be provided. The detector of the present invention, by contrast, is mountable without modification, and without special adaptor provision on one hundred sixty-five of the one hundred sixy-six different types of meters.

The second problem related to security, protecting the magnetic sensor from the effects of magnetic fields that might be applied accidentally or by people wishing to disrupt operation of the meter reading system. If left unprotected, the detectors could be "blinded" by an unauthorized application of a strong magnetic field. This problem required the improvization of various different shielding arrangements, each designed to fit an individual one, or, in some cases, a few of the different types of meters. The present invention avoids this problem by using an optical sensing device, and optically inhibiting it during times when it is desired that it not generate an output signal. The optical inhibiting arrangement effectively shields the device from all light during the OFF periods, so that the detector is essentially tamper proof so long as the housing of the meter is not broken into.

It is believed that the detector of the invention will be found to be useful in many other applications, most of which are presently not known to the inventor, and it is not desired to limit the claims herein to the field of meter reading, although the invention will be described in that environment.

BRIEF DESCRIPTION

Briefly, the detector includes a base for attachment to the face of the meter it is desired to read, a bell crank pivoted on the base for oscillatory rotation in response to rotation of the selected needle on the dial, a snap action toggle driven by the bell crank, and an optical detector for producing output signals responsively to changes in the toggle position. One arm of the bell crank is generally U-shaped and elliptically curved. It fits on the face of the meter with the selected needle between its opposite arms, so that as the needle rotates its tip pushes alternately against the two arms, causing the bell crank to oscillate, one cycle for each full rotation of the needle.

A tab is fixed to the opposite arm of the bell crank and is pivotally connected to one end of a C-spring. It drives the end of the C-spring back and forth through an arcuate path. The opposite end of the C-spring is pivoted at the distal end of a leaf spring, the opposite end of which is fixed to the base. The pivot connections are arranged to produce a toggle action causing the free end of the leaf spring to snap rapidly from one of its limit positions to the other at points about mid-way through the oscillatory motion of the bell crank.

An optical coupling device is mounted on the base adjacent to the leaf spring, and constitutes one of the limits of its motion. When the leaf spring is away from the coupler, the coupler is enabled because light emitted by the coupler is reflected from the leaf spring back to the coupler. When the spring is in engagement with the coupler it mechanically inhibits it, covering both the emitting and receiving faces of the device so that no light, especially light from an unauthorized source, can reach the receiving face to produce an erroneous output signal.

The toggle action is very fast, so the reading equipment is very unlikely to find an ambiguous reading. The snap action of the toggle ensures a very high speed change of position of the leaf spring; in effect, it spends practically all its time at one or the other of its limit positions, and negligible time in the transition zone between the two positions.

DETAILED DESCRIPTION

A presently preferred embodiment of the invention will now be described in detail in conjunction with the drawing, wherein:

FIG. 1 is an elevational view of the detector; and

FIG. 2 is a bottom view of the detector as shown in FIG. 1.

Referring to the drawing, the detector includes a base 10 having a flat rear surface for attachment as by an adhesive to the face of the meter it is desired to read. The bell crank 12 is pivoted on the base for angular oscillation in a vertical plane. Its driven end 14 is generally U-shaped, and includes two opposed arms 14A and 14B that fit around the selected needle 16 of the meter, so that as the needle rotates it pushes alternately against the two arms 14A and 14B causing the bell crank to oscillate synchronously with rotation of the needle.

A tab 18 is fixed to the opposite arm of the bell crank and its outer end is pivoted on one end of a C-spring 20. The opposite end of the C-spring 20 is pivoted on the distal end of the leaf spring 22, which is mounted at its opposite end on the base 10. As will be evident from the drawing, oscillation of the bell crank 12 causes the leaf spring 22 to toggle back and forth between its two limit positions, making a snap action transfer from one of the positions to the other about mid-way through the travel of the bell crank.

The upper limit position of the leaf spring 22 is defined by the face of an optical coupler 24 of the kind widely used as an end position switch, and as a sensor element in various types of motion transmitters. Any of a number of different commercially available couplers may be used according to the designer's choice. In the present embodiment a coupler made by the Siemens corporations and sold under the trade designation of SFH 900 Series has given entirely satisfactory service.

When the leaf spring 22 is in its lower position, against the stop 26, the coupler is enabled, and light emitted by it is returned by reflection from the leaf spring to produce an electrical output signal indicating that the bell crank, and also the needle, are in one half of their cycles. when the leaf spring is at its upper limit position, in contact with the coupler 24, the coupler is inhibited, the leaf spring blocks light from reaching the receiver face of the coupler from whatever source, and the coupler cannot produce an output signal in the positive sense, that is, an output signal indicating transmission of light from the emitting face to the receiving face of the coupler. This condition indicates to the reading circuit that the bell crank 12 and the meter needle 16 are in the other half of their cycles.

As desired, electrical circuit components (shown, but not separately designated) may be mounted on the base 10 along with the mechanical parts herein described, and they form no part of the present invention. They may be chosen by the designer to conform to the reading circuit of his system. A cover plate 28 is preferably provided to protect the mechanism from dust and any other deleterious effects found in general use. In the preferred embodiment the cover plate 28 serves also as a retainer to secure the movable parts such as the bell crank 12 and the C-spring 20 upon the base 10.

The bell crank 12 may be molded of polystyrene or formed of any other durable material, as desired. The C-spring 20 is preferably formed of a synthetic resin. A polyimide resin marketed under the tradename Kapton by the DuPont Corporation has given very satisfactory results in endurance tests. Springs made of this material have been tested and found to have substantially longer life than comparable springs made of other materials such as stainless steel or phosphor bronze. In addition, they are relatively immune to corrosion in ordinary atmospheres.

What is claimed is:

1. A position detector comprising a base, a lever pivoted on said base and having a first arm for positioning adjacent to the object the position of which it is desired to detect and arranged to be angularly oscillated responsively to changes in the position of the object, said lever having a second arm, a snap action toggle mechanism including a member mounted for snap oscillation between two predetermined limit positions, means connecting said second arm of said lever to said mechanism for operating said mechanism responsively to oscillation of said lever, whereby said member snaps from one of its limit positions to the other about midway through the oscillatory travel of said lever, an optical coupler mounted on said base and having emitting and receiving faces, said coupler constituting one of the limit stops for said toggle mechanism, said member abuttingly engaging said emitting and receiving faces when said member is at one of its limit positions and being spaced from said faces when it is at its other limit position, the surface of said member being reflective and serving to reflect light from the emitting face to the receiving face of said coupler when said member is spaced from the faces.

2. A detector for remote reading of a meter of the kind having a rotatable pointer mounted on its face, said detector comprising a base for attachment to the face of the meter adjacent to a pointer thereon, a bell crank pivoted on said base and having a U-shaped arm extending from said base and adapted to extend around the pointer so that the pointer drives the arm in angular oscillation responsively to rotation of the pointer, a toggle mechanism including a leaf spring fixed at one end on the base, its opposite end being free, limit means defining two, spaced apart limit positions for the free end of the leaf spring, spring means pivotally connected between the bell crank and the free end of said leaf spring for operating the toggle mechanism responsively to oscillation of said bell crank, driving the leaf spring with a snap action between its two limit positions, back and forth once for each complete cycle of oscillation of the bell crank, one of the limit means consisting of the emitting and receiving faces of an optical coupler, the surface of said leaf spring facing said optical coupler being reflective so that when the leaf spring is spaced from the coupler the coupler is enabled and when the leaf spring engages the coupler the coupler is positively inhibited.

3. A detector for producing an electrical output signal responsively to a predetermined change in the position of an object that is movable between two spaced apart limit positions, said detector comprising a base, a lever pivotted on said base and having an arm extending from its fulcrum for engagement by the object, said lever being arranged to be angularly oscillated in response to changes in position of the object as it moves between its limit positions, a snap action toggle mechanism including a member arranged to snap between two predetermined limit positions, means connecting said lever to said toggle mechanism for causing said member to snap alternately back and forth between its limit positions responsively to oscillation of said lever, and an optical coupler mounted on said base for sensing the instantaneous position of said lever, said coupler being arranged to produce an electrical output signal of one kind when the member is at one limit position and an output signal of a different, distinguishable kind when the member is at its other limit position, the positional relationship between said optical coupler and said member being such that when said member is at one of its limit positions it positively inhibits the optical coupler and effectively prevents the coupler from responding to light from any source.

* * * * *